US012595787B2

(12) United States Patent
Kim et al.

(10) Patent No.: US 12,595,787 B2
(45) Date of Patent: Apr. 7, 2026

(54) DIAPHRAGM PUMP

(71) Applicant: PROTEC CO., LTD., Gyeonggi-do (KR)

(72) Inventors: Keon Hee Kim, Incheon (KR); Sung Il Park, Gyeonggi-do (KR)

(73) Assignee: PROTEC CO., LTD., Gyeonggi-do (KR)

( * ) Notice: Subject to any disclaimer, the term of this patent is extended or adjusted under 35 U.S.C. 154(b) by 301 days.

(21) Appl. No.: 18/470,388

(22) Filed: Sep. 19, 2023

(65) Prior Publication Data

US 2024/0093682 A1 Mar. 21, 2024

(30) Foreign Application Priority Data

Sep. 20, 2022 (KR) ..... 10-2022-0118450

(51) Int. Cl.
*F04B 43/02* (2006.01)

(52) U.S. Cl.
CPC ..... *F04B 43/02* (2013.01)

(58) Field of Classification Search
None
See application file for complete search history.

(56) References Cited

U.S. PATENT DOCUMENTS 3,536,451 A * 10/1970 Ludwin ..... A61M 1/32 261/103
5,056,505 A * 10/1991 Warwick ..... A61M 16/0006 601/44
8,133,042 B2 3/2012 Yajima
9,341,172 B2 5/2016 Kohli et al.
10,867,818 B2 12/2020 Hong et al.
2002/0168275 A1* 11/2002 Cooper ..... F04B 17/03 417/415
2003/0194328 A1* 10/2003 Bryant ..... A61M 60/847 417/300
2004/0163181 A1* 8/2004 Wu ..... A61G 7/05776 5/713
2013/0101445 A1* 4/2013 Schutze ..... F04B 43/073 417/395
2015/0064025 A1* 3/2015 Verdugo ..... F04B 49/03 417/46
2016/0123319 A1* 5/2016 Hembree ..... F04B 53/16 417/398

(Continued)

FOREIGN PATENT DOCUMENTS

CN 102883990 1/2013
CN 105697791 6/2016

(Continued)

*Primary Examiner* — Dominick L Plakkoottam
*Assistant Examiner* — Geoffrey S Lee
(74) *Attorney, Agent, or Firm* — JCIPRNET

(57) ABSTRACT

Provided is a diaphragm pump. The diaphragm pump operates such that a viscous liquid is discharged by transferring a pressing force via a diaphragm that is elastically deformed. The diaphragm pump has a structure capable of rapidly and accurately discharging the viscous liquid of high viscosity by using a diaphragm. Also, the diaphragm pump is capable of effectively pressing the viscous liquid while preventing the damage to the particles contained in the viscous liquid, by preventing the mechanical structure pressing the viscous liquid from coming into direct contact with the viscous liquid.

9 Claims, 4 Drawing Sheets

(56) References Cited

U.S. PATENT DOCUMENTS

| | | | | |
|---|---|---|---|---|
| 2016/0136661 | A1* | 5/2016 | Hong | B05C 5/0225 239/1 |
| 2017/0120280 | A1* | 5/2017 | Hong | B05B 9/0403 |
| 2018/0171995 | A1* | 6/2018 | Minoia | F04B 43/0054 |
| 2019/0093652 | A1* | 3/2019 | Reinhard | F04B 49/10 |
| 2022/0099082 | A1* | 3/2022 | Oehrle | F04B 43/0054 |
| 2022/0299018 | A1* | 9/2022 | Reinhard | F04B 13/00 |

FOREIGN PATENT DOCUMENTS

| | | |
|---|---|---|
| EP | 0598182 | 2/1997 |
| GB | 2163528 | 2/1986 |
| KR | 20160072771 | 6/2016 |
| KR | 101833639 | 3/2018 |
| KR | 101833640 | 3/2018 |
| TW | 341625 | 10/1998 |
| TW | 201825189 | 7/2018 |
| WO | 2006120881 | 11/2006 |

* cited by examiner

DIAPHRAGM PUMP

CROSS-REFERENCE TO RELATED APPLICATION

This application is based on and claims priority under 35 U.S.C. § 119 to Korean Patent Application No. 10-2022-0118450, file on Sep. 20, 2022, in the Korean Intellectual Property Office, the disclosure of which is incorporated by reference herein in its entirety.

BACKGROUND

1. Field

The present disclosure relates to a diaphragm pump, and more particularly, to a diaphragm pump which discharges a viscous liquid by transferring a pressing force via a diaphragm that is elastically deformed.

2. Description of the Related Art

Pumps for dispensing a viscous liquid in accurate capacities at high speed are widely used in various industrial fields. Representatively, auger pumps of a screw type, linear pumps, piezo pumps, etc. are being used.

Generally, pumps according to the related art mostly have a structure in which a mechanical component applying pressure to a viscous liquid is in direct contact with the viscous liquid. As described above, while valve rods, screws, etc. of a pump come into direct contact with the viscous liquid to transfer the pressure, characteristics of the viscous liquid may be changed. For example, a chemical reaction may occur between a valve rod and a viscous liquid, and a mixture included in the viscous liquid may be damaged while contacting a screw, etc.

For example, a solder paste is a mixture of metal materials of a particle state or a powder state with the viscous liquid. A solder paste as above may be applied to a designated position or passage on a substrate by a pump to be used for mounting semiconductor components. However, when a solder paste is applied by the above pumps according to the related art, metal particles mixed in the viscous liquid may be damaged. When the metal particles are damaged as described above, processing defects may occur during a process of mounting semiconductor components on a substrate.

A diaphragm pump is used to apply a viscous liquid while avoiding direct contact between mechanical components pressing the viscous liquid and the viscous liquid. A diaphragm pump discharges the viscous liquid by indirectly transferring a pressure to the viscous liquid via a film of a membrane type.

In order to use a diaphragm pump so as to dispense accurate capacities at high speed in a process of applying a viscous liquid of high viscosity, a mechanical structure which is capable of effectively discharging the viscous liquid of high viscosity while rapidly and effectively operating is necessary.

SUMMARY

The present disclosure provides a diaphragm pump having a structure capable of rapidly and accurately discharging a viscous liquid of high viscosity.

Additional aspects will be set forth in part in the description which follows and, in part, will be apparent from the description, or may be learned by practice of the presented embodiments of the present disclosure.

According to an embodiment, a diaphragm pump according to the present disclosure includes: a syringe storing a viscous liquid; a transfer flow path provided with a pressing hole formed to have an opened side and connected to the syringe to be supplied with the viscous liquid; a housing coupled to the transfer flow path; a diaphragm installed in the housing so that at least a part thereof is exposed through the pressing hole of the transfer flow path and the viscous liquid in the transfer flow path is pressed through elastic deformation; a plunger installed to be slidable with respect to the housing so as to press the diaphragm and elastically deform the diaphragm; an actuator unit operating the plunger to be moved forward/backward with respect to the housing; and a nozzle connected to the transfer flow path so as to discharge the viscous liquid to outside when the diaphragm that is elastically deformed by the plunger presses the viscous liquid.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
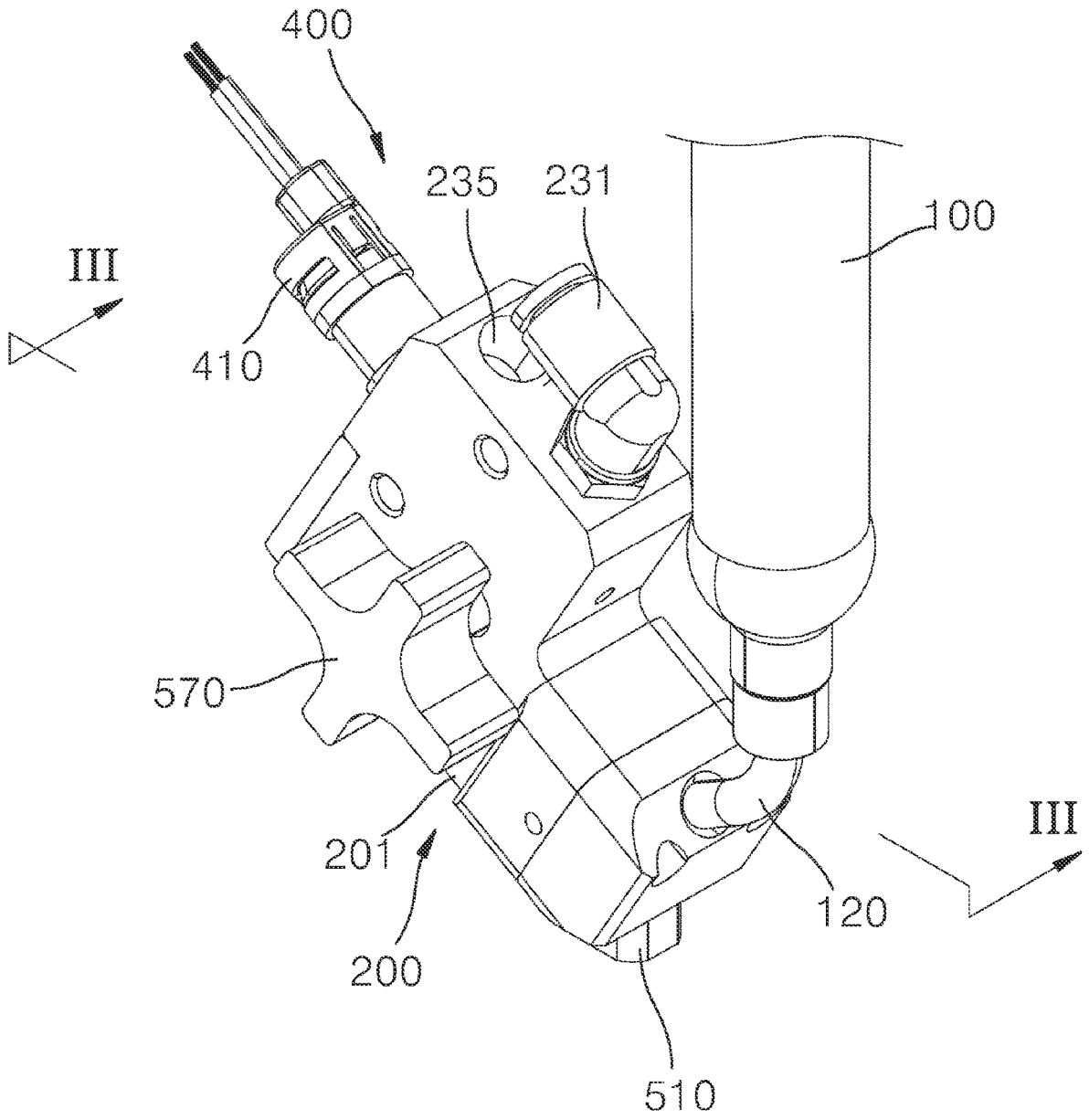
FIG. 1 is a perspective view of a diaphragm pump according to an embodiment of the present disclosure.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects. As used herein, the term "and/or" includes any and all combinations of one or more of the associated listed items. Expressions such as "at least one of," when preceding a list of elements, modify the entire list of elements and do not modify the individual elements of the list.

Hereinafter, a diaphragm pump according to one or more embodiments of the present disclosure is described in detail later with reference to accompanying drawings.

Figure 2:
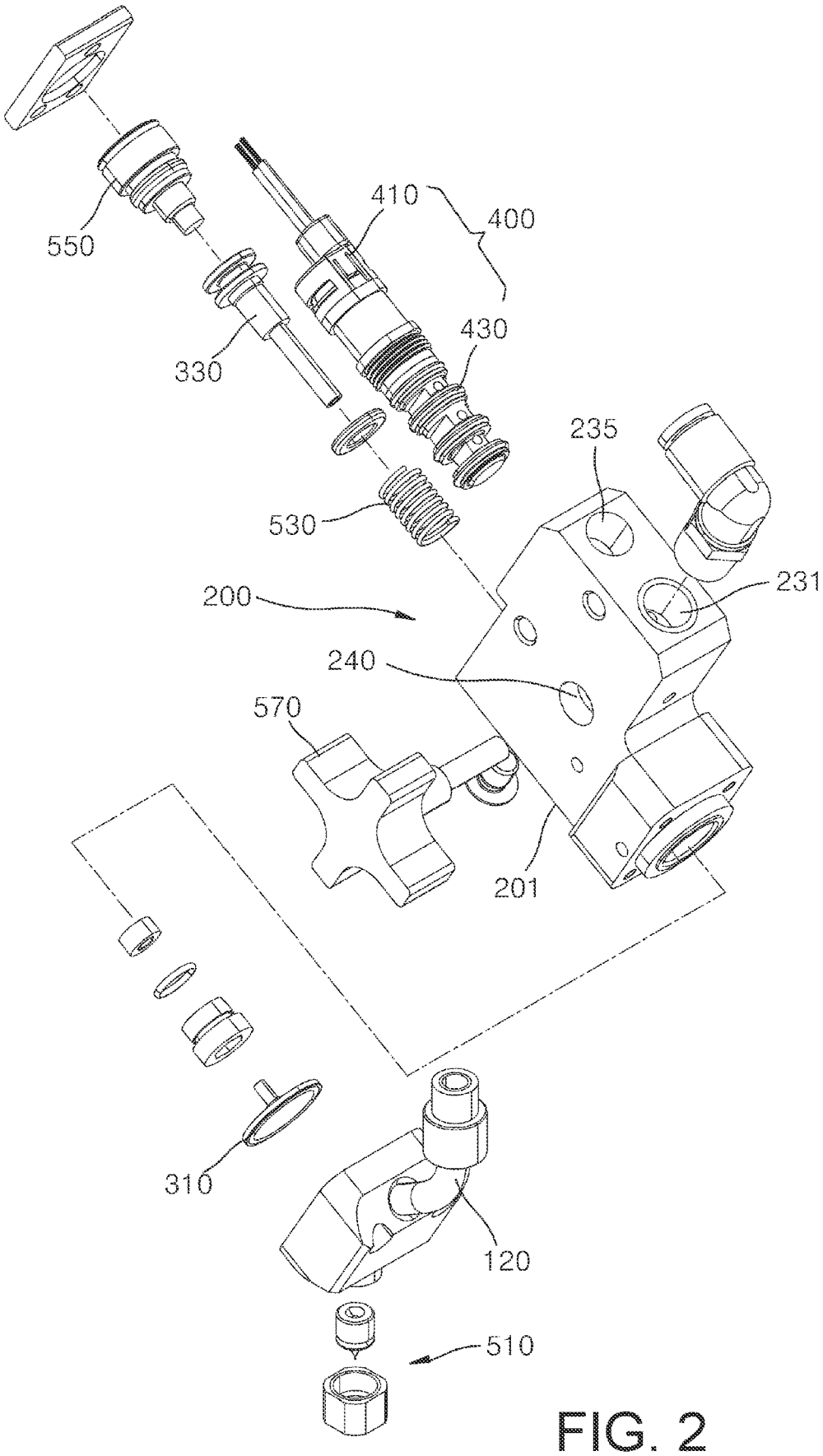
FIG. 2 is an exploded perspective view of the diaphragm pump of FIG. 1.
Figure 3:
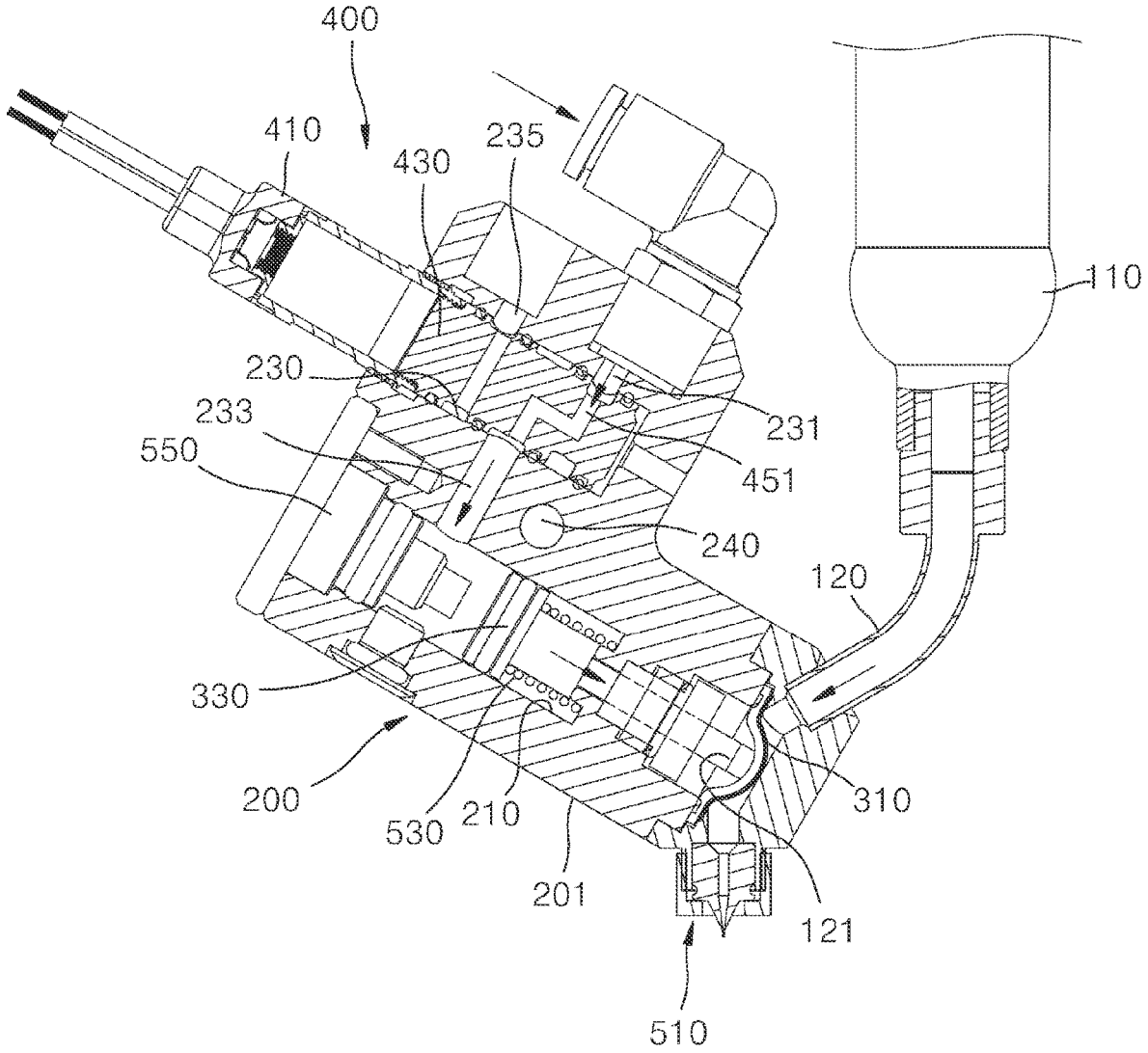
FIGS. 3 and 4 are cross-sectional views of the diaphragm pump taken along line III-III of FIG. 1.
Figure 4:
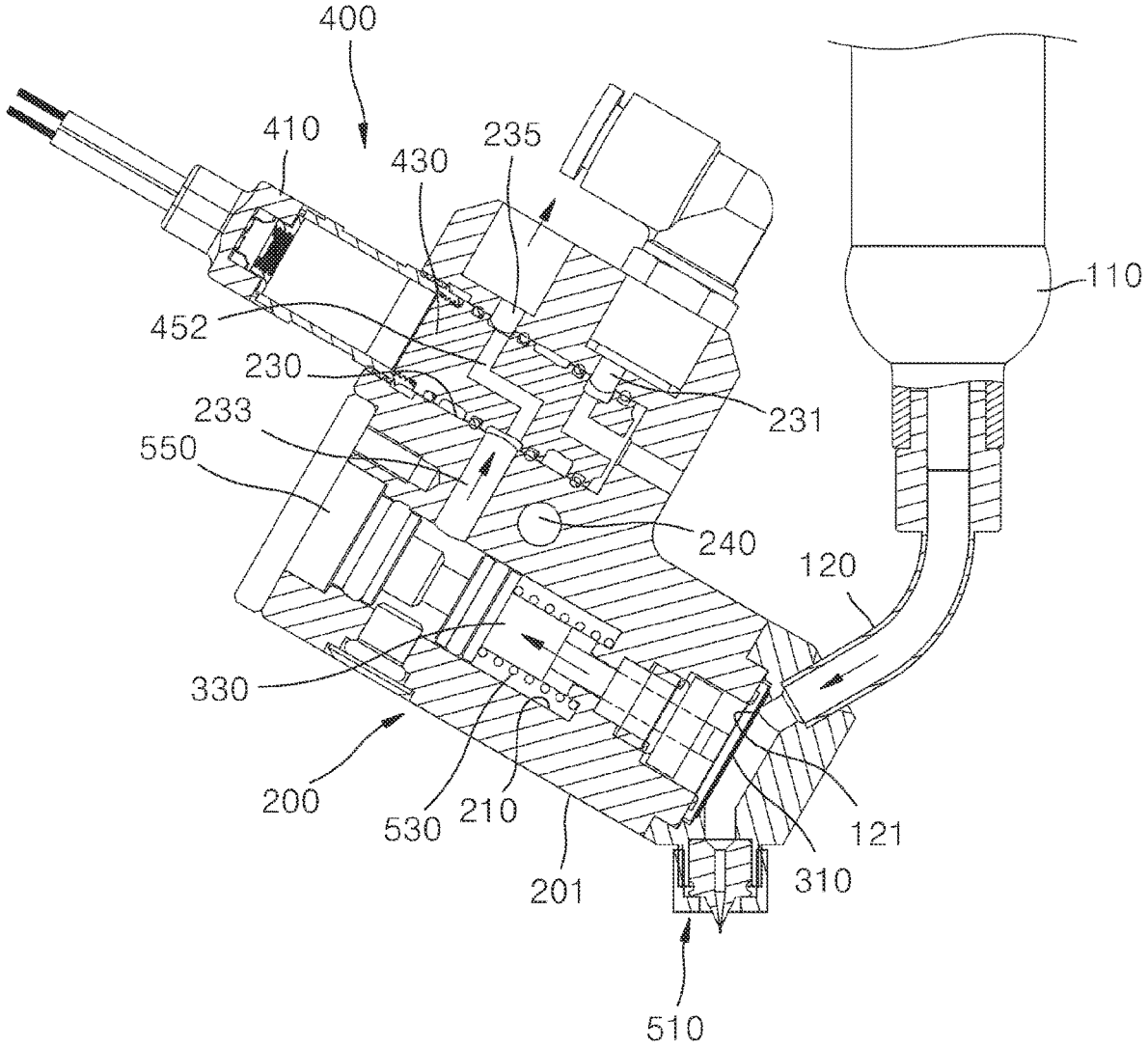

FIG. 1 is a perspective view of a diaphragm pump according to an embodiment of the present disclosure, FIG. 2 is an exploded perspective view of the diaphragm pump of FIG. 1, and FIGS. 3 and 4 are cross-sectional views of the diaphragm pump taken along line III-III of FIG. 1.

Referring to FIGS. 1 to 4, the diaphragm pump according to the embodiment includes a syringe 110, a transfer flow path 120, a housing 200, a diaphragm 310, a plunger 330, an actuator unit 400, and a nozzle 510.

The syringe 110 is a structure for storing a viscous liquid to be dispensed. The syringe 110 is connected to a pneumatic device such as a regulator to press the viscous liquid in the syringe 110 with a preset pressure. The viscous liquid in the syringe 110 pressed by compressed air is transferred to the transfer flow path 120 connected to the syringe 110. The viscous liquid used in the diaphragm pump according to the present disclosure may be a concept including a material such as a solder paste, in which metal particles in a powder type or solder balls are mixed with a resin, as well as a synthetic resin solution.

The transfer flow path 120 is connected to the syringe 110 and is supplied with the viscous liquid to transfer the viscous liquid to the nozzle 510. The transfer flow path 120 may be formed as a conduit type such as a pipe and may be formed of a combination of a plurality of components. In the embodiment, the syringe 110 is formed to extend in upper and lower directions, and the transfer flow path 120 is connected to a lower portion of the syringe 110. As shown in FIGS. 3 and 4, the transfer flow path 120 extends from the syringe 110 perpendicularly downward and is curved in an inclined direction, and then, extends again to the perpendicularly downward direction. The transfer flow path 120 is curved smoothly. The reason why the transfer flow path 120 is not formed straightly, but is curved will be described later.

The transfer flow path 120 is not bent with a rapid angle change, such as at a right angle, but is curved smoothly, in order not to form bubbles of vapor in the transfer flow path 120. When corners exist in the transfer flow path 120, there may be a space in which the viscous liquid is not completely filled, and thus, vapor may be generated in the viscous liquid and may be discharged with the viscous liquid later. In order to address the above issue, according to the embodiment, the transfer flow path 120 may be curved in a smooth curvature as shown in FIG. 3.

A pressing hole 121 is formed at an inflection point where the transfer flow path 120 is curved as described above. The pressing hole 121 is formed by opening one side of the transfer flow path 120.

The transfer flow path 120 described above is formed to pass the inside of the housing 200 and is coupled to the housing 200.

The diaphragm 310 is formed of an elastic material that may be elastically deformed and is formed as a plate of membrane type. The diaphragm 310 is installed in the housing 200 so as to come into contact with the pressing hole 121 of the transfer flow path 120 and cover and block the pressing hole 121. That is, the diaphragm 310 is installed in the housing 200 to be arranged at a position where a central portion may be exposed through the pressing hole 121. According to the above structure, when the diaphragm 310 is pushed from an outer side of the pressing hole 121 and is elastically deformed, the diaphragm 310 presses the viscous liquid in the transfer flow path 120.

The nozzle 510 is connected to the lower end portion of the transfer flow path 120. When the diaphragm 310 presses the viscous liquid in the transfer flow path 120 via the pressing hole 121, the viscous liquid in the transfer flow path 120 is discharged to outside through the nozzle 510 due to the pressure.

The diaphragm 310 is pressed by the plunger 330 and elastically deformed. The plunger 330 is installed to be slidable with respect to the housing 200 and presses the diaphragm 310. In the embodiment, the plunger 330 is fastened with the diaphragm 310 in a screw-coupling method as shown in FIG. 3. A female screw portion at the end of the plunger 330 is fastened with a male screw portion that is formed protruding from a rear surface of the diaphragm 310.

The plunger 330 is installed in the housing 200 so as to move forward and backward with respect to the diaphragm 310. Referring to FIGS. 3 and 4, a plunger seating portion 210 formed as a cylinder is formed in the housing 200. The plunger seating portion 210 is formed in a cylindrical shape extending in a direction in which the plunger 330 is moved forward/backward. The plunger 330 is formed as a piston to be inserted and installed in the plunger seating portion 210. An O-ring is installed on an outer circumference of the plunger 330 so as to hermetically seal between the plunger 330 and the plunger seating portion 210. As described above, due to the structure of the plunger 330 and the plunger seating portion 210 formed in a piston-cylinder structure, the plunger 330 is moved forward/backward with respect to the diaphragm 310 according to a pneumatic pressure applied to the plunger seating portion 210.

The actuator unit 400 operates the plunger 330 to be moved forward/backward with respect to the housing 200. The actuator unit 400 that operates the plunger 330 to be moved forward/backward may include various types of actuators, but in the embodiment, the actuator unit 400 of a 3-way valve type is used. Accordingly, the actuator unit 400 of the embodiment transfers the pneumatic pressure to the plunger seating portion 210 in the housing 200 to operate the plunger 330. To this end, the housing 200 has a feeding port 231, an operating port 233, and a discharge port 235 formed therein. External compressed air is transferred to the feeding port 231. The operating port 233 is formed to be in communication with the plunger seating portion 210 and transfers the pressure from the feeding port 231 to the plunger seating portion 210. The discharge port 235 is formed to discharge the compressed air in the housing 200 to outside when the plunger 330 is moved backward. The actuator unit 400 makes the plunger 330 reciprocate by alternately connecting the operating port 233 to the feeding port 231 and the discharge port 235. As described above, the actuator unit 400 selectively connecting the operating port 233 to the feeding port 231 and the discharge port 235 may include a 3-way valve of various shapes, but in the embodiment, the actuator unit 400 has a structure of a rotary 3-way valve.

Accordingly, the actuator unit 400 is provided with a rotary spool 430, a motor 410, a first flow path 451, and a second flow path 452. The rotary spool 430 is connected to the motor 410 to be rotated by the motor 410 and is formed as a cylinder. A spool seating portion 230 is formed in the housing 200. The spool seating portion 230 is formed in the housing 200 at a position where the spool seating portion 230 is in communication with the feeding port 231, the discharge port 235, and the operating port 233, respectively. The rotary spool 430 is inserted and installed in the spool seating portion 230 of the housing 200. The rotary spool 430 has the first flow path 451 and the second flow path 452 formed therein. The first flow path 451 and the second flow path 452 are formed so as to connect the operating port 233 respectively to the feeding port 231 and the discharge port 235 according to a rotating angle displacement of the rotary spool 430. The first flow path 451 is formed to connect the operating port 233 to the feeding port 231, and the second flow path 452 is formed to connect the operating port 233 to the discharge port 235. When the motor 410 rotates the rotary spool 430 and the first flow path 451 is opened, the pneumatic pressure of the feeding port 231 is transferred to the operating port 233 to move the plunger 330 forward. When the motor 410 rotates the rotary spool 430 again so that the first flow path 451 is closed and the second flow path 452 is opened, the compressed air in the plunger seating portion 210 is discharged through the discharge port 235 and the plunger 330 is moved backward.

Here, a return spring 530 is installed in the housing 200 in order to assist the plunger 330 to move backward. The return spring 530 is installed between the housing 200 and the plunger 330 in order to provide the elastic force in a direction in which the plunger 330 is moved backward. In the embodiment, the return spring 530 is arranged to surround one side of the plunger 330 and is installed between a projection of the plunger 330 and an inner wall of the plunger seating portion 210. Accordingly, the return spring 530 provides the plunger 330 with the elastic force in a direction away from the diaphragm 310.

In addition, a stroke adjusting member 550 is installed behind the plunger 330. The stroke adjusting member 550 operates as a stopper and adjusts a moving-back displacement of the plunger 330 when the plunger 330 is retreated. That is, the plunger 330 is not further retreated when being caught by the stroke adjusting member 550. In the embodiment, the stroke adjusting members 550 of various sizes are prepared in advance to be replaceable and installed in the housing 200 as necessary, and thus the stroke of the plunger 330 may be adjusted. In some cases, a stroke adjusting member that is screw-coupled to the housing 200 may be used. The stroke adjusting member of a screw-coupling structure adjusts the retreating displacement of the plunger 330 by going forward and backward with respect to the plunger seating portion 210 of the housing 200 according to the rotating angle.

The diaphragm pump of the embodiment is installed in a dispenser that moves the diaphragm pump in vertical and horizontal directions to be used. In order to install the diaphragm pump of the embodiment in the dispenser, the housing 200 has a coupling hole 240 formed through the housing 200. The housing 200 is installed in the dispenser by using a fixing knob 570. When the fixing knob 570 is fastened with a bracket of the dispenser via the coupling hole 240 of the housing 200, the housing 200 is installed in the dispenser. As described above, the housing 200 and other components installed in the housing 200 may be easily installed in a main device by using the fixing knob 570 and the coupling hole 240, and thus, attaching/detaching may be easily performed and replacement of the pump for repair and maintenance is easy.

In addition, the diaphragm pump of the embodiment has the housing 200 of which the lower surface is formed as an inclined surface 201, so that the diaphragm pump does not interfere with a material and other peripheral components when being horizontally transported while discharging the viscous liquid onto the material disposed on the base of the dispenser at a close distance. As shown in FIGS. 1 to 4, the nozzle 510 is arranged in a vertical direction so as to discharge the viscous liquid in a vertically downward direction. Also, the lower surface of the housing 200 is formed as the inclined surface 201 that is inclined upward away from the nozzle 510. Accordingly, there is no component interfering with the material and peripheral devices around the nozzle 510, and the housing 200 is not located at a height similar to the nozzle 510. As described above, the housing 200 needs to be miniaturized and to maintain the discharging performance of the viscous liquid while having the inclined surface 201. To this end, the plunger 330 and the plunger seating portion 210 of the diaphragm pump according to the embodiment are arranged in a direction inclined with respect to a spraying direction of the nozzle 510. That is, the plunger 330 and the plunger seating portion 210 are arranged to extend in a direction parallel to the inclined surface 201 of the housing 200. Through the above configuration, the housing 200 does not have an unnecessary space while having the inclined surface 201 and has a compact structure. Also, in correspondence with the inclined structure of the plunger 330, the diaphragm 310 is arranged in a direction perpendicular to the extending direction of the plunger 330 so that the diaphragm 310 may effectively press the viscous liquid. As described above, the transfer flow path 120 is not formed in a straight type, but has a curved structure so that the pressing force caused by the elastic deformation of the diaphragm 310 is effectively transferred to the viscous liquid in accordance with the inclined structure of the plunger 330. That is, the transfer flow path 120 is curved so that a middle part thereof is perpendicular to the movement direction of the plunger 330, and then, is curved in the vertical direction so that the viscous liquid may be transferred to the nozzle 510 in the vertically downward direction.

Hereinafter, the operations of the diaphragm pump having the above structure are described below.

As shown in FIG. 1, the housing 200 is attached to the bracket of the dispenser by using the fixing knob 570. Next, the syringe 110 in which the viscous liquid is filled is attached to the housing 200. The regulator is connected to the syringe 110 so as to provide the pneumatic pressure. Accordingly, the viscous liquid in the syringe 110 is supplied to the nozzle 510 through the transfer flow path 120. The viscous liquid used in the diaphragm pump according to the present disclosure generally has high viscosity and the nozzle 510 has smaller diameter, and thus, the viscous liquid may not be discharged through the nozzle 510 only by the pneumatic pressure applied to the syringe 110.

In the above state, when the motor 410 of the actuator unit 400 is operated, the motor 410 rotates the rotary spool 430. The first flow path 451 and the second flow path 452 of the rotary spool 430 are alternately opened according to the rotating angle displacement of the rotary spool 430. When the first flow path 451 is opened, the external compressed air is transferred to the operating port 233 via the feeding port 231, and when the second flow path 452 is opened, the compressed air in the housing 200 is discharged through the discharge port 235 via the operating port 233. According to the above structure, the actuator unit 400 converts the rotation of the motor 410 into a linear reciprocating movement of the plunger 330.

Referring to FIG. 3, when the first flow path 451 is opened, the compressed air supplied to the operating port 233 from the feeding port 231 is transferred to the plunger seating portion 210. When the pressure of the plunger seating portion 210 increases, the plunger 330 of a piston type is moved forward to elastically deforms the diaphragm 310. Here, the plunger 330 moves forward while overcoming the elastic force of the return spring 530. The diaphragm 310 that is elastically deformed presses the viscous liquid via the pressing hole 121, and due to the increase in the pressure caused thereby, the viscous liquid is discharged through the nozzle 510.

As shown in FIG. 4, when the rotary spool 430 is rotated by 180-degrees due to the motor 410 so that the first flow path 451 is closed and the second flow path 452 is opened, the discharge port 235 and the operating port 233 are in communication with each other. The plunger 330 is moved backward due to the elastic force of the return spring 530, and the compressed air filled in the plunger seating portion 210 is discharged to outside through the discharge port 235 via the second flow path 452. As described above, when there is the return spring 530, the plunger 330 may be moved backward only by the elastic force of the return spring 530 without connecting a vacuum suction device to the discharge port 235. Here, the diaphragm 310 connected to the plunger 330 sucks the viscous liquid into the space around the pressing hole 121 while elastically being recovered. Here, the viscous liquid transferred to the syringe 110 through the transfer flow path 120 is filled in the peripheral region of the pressing hole 121. As described above, the viscous liquid filled in the peripheral region of the pressing hole 121 is pressed again during next elastic deformation of the diaphragm 310 and then is discharged through the nozzle 510. Because the inner diameter of the transfer flow path 120 connected to the syringe 110 is relatively large and the inner diameter of the nozzle 510 is relatively small, the viscous liquid at the side of the syringe 110 is mainly filled in the peripheral region of the pressing hole 121 when the plunger 330 is retreated.

When the motor 410 is continuously rotated, the above processes are repeated and the plunger 330 performs reciprocating movement back and forth rapidly. The diaphragm 310 discharges the viscous liquid through the nozzle 510 while rapidly repeating the elastic deformation and the elastic recovery. According to the diaphragm pump of the embodiment, the rotary 3-way valve and the pneumatic cylinder of the pneumatic cylinder type are organically combined to form the actuator unit 400, and thus, the fast and strong reciprocating movement of the plunger 330 may be implemented with a simple and compact mechanical configuration. Also, the diaphragm pump according to the present disclosure generates an actuating displacement of the plunger 330, which is sufficient enough to deform the diaphragm 310 of an elastic material, while operating with fast and strong force, and thus, the viscous liquid of high viscosity may be discharged through the nozzle 510 accurately with a sufficient flow rate.

As described above, because the end portion of the plunger 330 and the diaphragm 310 are screw-coupled to each other, the diaphragm 310 is also moved in synchronization with the movement of the plunger 330 that reciprocates at high speed. Even when the elastic force of the diaphragm 310 is not enough, the plunger 330 fastened with the diaphragm 310 helps the diaphragm 310 rapidly recover the shape.

As described above, because the diaphragm pump according to the present disclosure presses the diaphragm 310 with a strong force by using the plunger 330, the liquid of high viscosity such as a solder paste may be dispensed at high speed with set quantities. Also, because the diaphragm 310 is formed of the elastic material as described above, the diaphragm pump of the present disclosure may perform the dispensing operation at high speed without damaging the metal particles of powder type contained in the solder paste. As such, the diaphragm pump of the present disclosure may improve the quality of a solder paste dispensing process.

As described above, because the stroke adjusting member 550 is installed in the housing 200, the stroke of the plunger 330 is adjusted by the stroke adjusting member 550. The projection formed on the plunger seating portion 210 operates as a stopper and restricts the maximum displacement in the forward movement of the plunger 330. A move-back displacement of the plunger 330 is adjusted by the stroke adjusting member 550. As described above, the stoke adjusting member 550 may be manufactured in various sizes to be replaced as necessary, and may be coupled to the housing 200 in a screw-coupling method to adjust the position thereof. Also, as shown in FIG. 3, the configuration of adjusting the rear position of the stroke adjusting member 550 may be installed in the housing 200 in a screw-coupling method to adjust the stroke.

A device for applying the viscous liquid may dispense the viscous liquid by making the nozzle 510 approach the material as close as possible. According to the above method, the viscous liquid (e.g., solder paste) of an accurate capacity may be discharged onto an accurate position of the material such as a semiconductor substrate. The diaphragm pump of the embodiment has the inclined surface 201 as the lower surface of the housing 200 as described above, so that the dispensing operation may be performed without interfering with other components even at the position close to the material. As such, other components than the nozzle 510 do not exist on the lower portion of the diaphragm pump so as to allow an operation to be possible close to the material. Also, the plunger 330, the plunger seating portion 210, the rotary spool 430, and the spool seating portion 230 are arranged to be inclined in the same direction so as to miniaturize the total size of the pump and maintain the force of discharging the viscous liquid while forming the lower surface of the housing 200 as the inclined surface 201. At the same time, the transfer flow path 120 is also curved so that there is a section extending in the direction perpendicular to the plunger 330, and thus, the energy of the plunger 330 may be effectively transferred to the viscous liquid through the pressing hole 121. The transfer flow path 120 is formed to be curved smoothly without rapid changing the angle as described above, and thus, there is no corner where the vapors may appear do not exist in the passage of the transfer flow path 120. Therefore, at an initial stage, when the viscous liquid is filled in the syringe 110 and is discharged to the nozzle 510 while entirely filling the transfer flow path 120 through a purge process, the air in the transfer flow path 120 is easily discharged and the vapor is not formed in the viscous liquid.

When using up the viscous liquid in the syringe 110, the syringe 110 may be replaced. Also, the housing 200 and the components installed in the housing 200 may be separated from the main device by loosening the fixing knob 570. As described above, because the housing 200 may be easily separated by using the fixing knob 570, another pump may be easily replaced to be used. Also, the diaphragm pump of the embodiment has a structure that is easily separated for repair and maintenance or cleaning and then is attached again.

The examples of the present disclosure are described above, but the scope of the present disclosure is not limited thereto.

For example, the motor 410 and the actuator unit 400 configured as a rotary 3-way valve are described above, but other than the above structure, actuator units having various structures such as a solenoid, a linear motor, and a ring-pinion structure may be used as the actuator. The actuator unit may be formed by using a piezo actuator. When the piezo actuator is used, a strong power may be obtained and the operating displacement of the actuator unit may be accurately controlled.

Also, for the plunger 330, a plunger that reciprocates may be formed to have other various structures than the pneumatic cylinder having the piston-cylinder structure described above. For example, the plunger may be configured as a slider installed in a linear guide.

Also, a diaphragm pump having no return spring 530 described above may be configured, or a return spring having a different structure from the above description may be used.

Also, a diaphragm pump having a structure in which the plunger 330 and the diaphragm 310 are not coupled to each other may be configured.

Also, a diaphragm pump having no stroke adjusting member 550 or a stroke adjusting member of different structure may be configured.

Also, unlike the above description, the housing having no inclined surface 201 may be used, and the diaphragm pump in which the plunger seating portion and the spool seating portion are arranged not to be inclined may be formed.

In addition, the transfer flow path 120 may be formed in a straight-line shape, not the curved shape, and a transfer flow path that is bent, not curved, may be used. In some cases, the diaphragm pump may be formed so that the plunger and the transfer flow path are arranged in a T-shape.

The diaphragm pump according to the present disclosure has a structure capable of rapidly and accurately discharging the viscous liquid of high viscosity by using a diaphragm.

Also, the diaphragm pump according to the present disclosure is capable of effectively pressing the viscous liquid while preventing the damage to the particles contained in the viscous liquid, by preventing the mechanical structure pressing the viscous liquid from coming into direct contact with the viscous liquid.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope as defined by the following claims.

What is claimed is:

1. A diaphragm pump comprising:

a syringe storing a viscous liquid;

a transfer flow path provided with a pressing hole formed to have an opened side and connected to the syringe to be supplied with the viscous liquid;

a housing coupled to the transfer flow path;

a diaphragm installed in the housing so that at least a part thereof is exposed through the pressing hole of the transfer flow path and the viscous liquid in the transfer flow path is pressed through elastic deformation;

a plunger installed to be slidable with respect to the housing so as to press the diaphragm and elastically deform the diaphragm;

an actuator unit operating the plunger to be moved forward/backward with respect to the housing; and a nozzle connected to the transfer flow path so that, when the diaphragm is elastically deformed by the plunger and presses the viscous liquid, the viscous liquid is discharged to outside, wherein the housing includes a plunger seating portion formed as a cylinder, the plunger is formed as a piston type and installed in the plunger seating portion, and the actuator unit operates the plunger by transferring a pneumatic pressure to the plunger seating portion of the housing, wherein the housing includes a feeding port for transferring external compressed air, an operating port being in communication with the plunger seating portion, and a discharge port for discharging compressed air in the housing to outside, and the actuator unit operates the plunger by alternately connecting the feeding port and the discharge port to the operating port, wherein the housing further includes a spool seating portion that is formed at a position where the spool seating portion is in communication with each of the feeding port, the discharge port, and the operating port, and the actuator unit comprises a rotary spool installed in the spool seating portion of the housing to be rotatable, a motor for rotating the rotary spool, and a first flow path and a second flow path that are formed in the rotary spool so as to connect the operating port to each of the feeding port and the discharge port according to a rotating angle displacement of the rotary spool.

2. The diaphragm pump of claim 1, further comprising a return spring installed in the housing so as to provide the plunger with an elastic force in a direction in which the plunger is moved backward.

3. The diaphragm pump of claim 1, wherein an end portion of the plunger is coupled to the diaphragm.

4. The diaphragm pump of claim 1, further comprising a stroke adjusting member installed in the housing to be caught by the plunger when the plunger is moved backward so as to restrict a move-back displacement of the plunger.

5. The diaphragm pump of claim 4, wherein the stroke adjusting member is screw-coupled to the housing so as to adjust the move-back displacement of the plunger.

6. The diaphragm pump of claim 1, wherein the housing has a coupling hole formed through the housing, and the diaphragm pump further comprises a fixing knob formed to fix the housing to an external device via the coupling hole of the housing.

7. The diaphragm pump of claim 1, wherein the nozzle is arranged to discharge the viscous liquid in a vertically downward direction, and a lower surface of the housing has an inclined surface that is formed to be away from the nozzle in an upward direction.

8. The diaphragm pump of claim 1, wherein the plunger and the plunger seating portion are arranged to extend in a direction that is inclined with respect to a spraying direction of the nozzle.

9. The diaphragm pump of claim 1, wherein the transfer flow path is formed to be curved, and the pressing hole of the transfer flow path is arranged at a position of an inflection point where the transfer flow path is curved.

* * * * *